United States Patent [19]

Ribback

[11] 4,027,518

[45] June 7, 1977

[54] HYDRAULIC PRESS

[76] Inventor: Erich Ribback, Maximiner Acht 39, 55 Trier, Germany

[22] Filed: Apr. 23, 1975

[21] Appl. No.: 570,697

[52] U.S. Cl. ..... 72/306; 72/407; 72/467; 72/477

[51] Int. Cl.[2] ..... B21D 19/00

[58] Field of Search ..... 72/306, 360, 318, 354, 72/402, 401, 404, 400, 417, 407, 453, 476, 455, 477, 467; 269/265, 268, 270, 321 N

[56] References Cited

UNITED STATES PATENTS

| | | | |
|---|---|---|---|
| 1,571,737 | 2/1926 | Schanandoah | 72/407 X |
| 1,867,936 | 7/1932 | Benedetto | 72/407 X |
| 1,983,074 | 12/1934 | Durell | 72/284 X |
| 2,170,519 | 8/1939 | Oelkers | 72/417 X |
| 2,837,135 | 6/1958 | Demler | 72/477 |
| 2,932,995 | 4/1960 | Durfee | 269/268 X |
| 3,038,592 | 6/1962 | Kelday et al. | 72/467 |
| 3,342,057 | 9/1967 | Stone | 72/477 |
| 3,588,933 | 6/1971 | Shiuopulos et al. | 72/354 X |
| 3,610,017 | 10/1971 | Harris | 72/417 X |

*Primary Examiner*—Milton S. Mehr
*Attorney, Agent, or Firm*—Allison C. Collard

[57] ABSTRACT

A hydraulic press for metal working of end portions of rod-like or pipe-like metallic work pieces comprising a clamping device for arresting the work piece, and a hydraulic press cylinder, having piston rods which move toward the work piece. Working tools are disposed on the piston rods, and press cylinders are disposed on both sides of said clamping device, whereby the piston rods of the press cylinders are moved toward each other in a longitudinal direction of the work piece.

3 Claims, 5 Drawing Figures

HYDRAULIC PRESS

The invention relates to a hydraulic press for metal working of end portions of rod-like or pipe-like metallic work pieces, in particular, for expanding or drawing in the ends of pipe-like work pieces having a clamping means which retains or arrests the work piece, and a hydraulic press cylinder, whereby the piston rod moves toward the work piece. The piston rod is provided with a working tool.

In accordance with the state of the art, hydraulic presses of the aforementioned types are known. In these presses the working tool which is mounted on the piston rod of the press cylinder is provided with a drawing-in ring or an expansion mandrel. The tool is then moved against the end portion of the work piece which is held in position in the clamping means by the press cylinders, whereby the end of the work piece is formed into the desired shape. The required press force for deforming the work piece must be fed into the chuck jaws of the clamping means, without causing markings or deformations on the work piece in the area of the chuck jaws. In order to feed the pressure force into the chuck jaws, the clamping force must be five times that of the pressure force, which usually results in undesired deformations or at least in markings in the area of the work piece which is arrested by the chuck jaws.

It is therefore one object of the invention, to improve the press of the aforementioned type, so that these undesired deformations or markings are eliminated.

To achieve this object in accordance with the invention it is suggested to provide press cylinders on both sides of the press clamping means, whereby the piston rods move against each other in longitudinal direction of the work piece. In the press of the invention, the work piece is worked on both ends simultaneously, so that the pressure forces which usually have to be fed into the clamping means balance each other out. A further advantage to work the work piece on both ends simultaneously is to be seen in the increased operating speed of the press. In the hitherto known hydraulic presses of the aforementioned type, the two ends of the work piece had to be worked on successively, while the press of the subject invention permits a simultaneous working on both ends of the work piece.

In accordance with the preferred embodiment of the invention, the clamping means in provided with two oppositely positioned hydraulic clamping cylinders, the piston rods of which are moved laterally with respect to the longitudinal direction of the work piece. Clamping jaws are provided on the front ends of the piston rods. Such a clamping means can be easily opened and closed for placing new work pieces therein. Since the clamping means does not have to absorb any pressure forces, the displacement of the clamping jaws on the piston rods of the clamping cylinders is sufficient.

Advantageously the press cylinders and the clamping cylinders are arranged in a common vertical plane. The press cylinders and the clamp cylinders may be arranged in a common vertical frame, so that elaborate foundation and and lateral abutments can be eliminated. Very good transport possibilities do exist in the area of the work piece feeding and the work piece discharge area when the press cylinders are in a horizontal position and the clamping cylinder is in a vertical position. With this arrangement of the press cylinders and the clamping cylinders, the work pieces may be placed onto a roller table or on a plate belt and may be fed through the vertical press frame and gripped by the clamping means when the work pieces are in the area of the oppositely positioned press cylinders.

In order to provide for a fast work piece exchange and a possible successive deforming process in a single clamping of the work piece, the working tools are mounted on the front ends of the piston rods of the press cylinders by means of rotatable turret heads carrying a plurality of tools.

Advantageously, the clamping jaws are mounted at the front end of the piston rods of the clamping cylinders and are adjusted to the shape of the center of the work piece. Thereby, the work piece is not only positioned correctly, but its center position is supported, so that undesirable deformations in the center portion are eliminated. This is of importance, in particular, when making rear axles for trucks, wherein a ring-like center portion (banjo axle) is provided for receiving the differential drive. This ring-like center section is relatively sensitive against axial forces. In order to protect this center section against axial forces, the clamping jaws may be provided with round shoulders, which fit into the ring like center section. These shoulders on the clamping jaws provide an inside support for the banjo axle, so that it will not collapse when working the axle ends with the press tools.

The press in accordance with the invention permits to operate with substantially higher pressure tools than heretofore possible with the known presses. For this purpose a larger output can be obtained, because only one deforming step is required. The highest possible deformation in the known process is limited due to the insufficient clamping. In these presses only drawing-in tools may be used, which do not require a high pressure force.

In the previously known presses, it is not possible, for example, to use drawing-in rings, the deformation ratio of which is larger than 1.3 (the deformation ratio being from the initial diameter to the final diameter).

However, the press in accordance with the present invention permits considerably larger deformation ratios, whereby the working tools are formed as tapered drawing in tools, which have a tapered cone angle at the outlet opening for the work piece. In the subsequent center section, a plurality of inwardly extending radial ribs are provided, and at the subsequent end section, a larger cone angle is provided. Such a drawing-in ring reduces the diameter of the work piece a little bit at the beginning, and then impresses fold into the work piece, which are directed inwardly into the work piece, by means of the radial-extending ribs provided in the drawing-in ring. Subsequently, the work piece enters the end section, which has the large cone angle, wherein the folds in the outer face of the work piece are pushed together into a very tight relationship, so that an almost closed cylindrical surface area is obtained on the outer wall of the work piece. Thereby, the radial ribs are so coordinated with the end diameter of the drawing-in ring that the folds on the work piece which were created by the ribs are completely closed on the outer circumference of the work piece.

The press in accordance with the invention permits, for example, a production of the required deformation on the axle ends, in one operating step, in a pipe-like blank when making rear axles for trucks. For such operations, a plurality of successive deforming steps were heretofore required.

One embodiment of a hydraulic press, in accordance with the invention will now be described in accordance with the attached drawings which show in.

Figure 1:
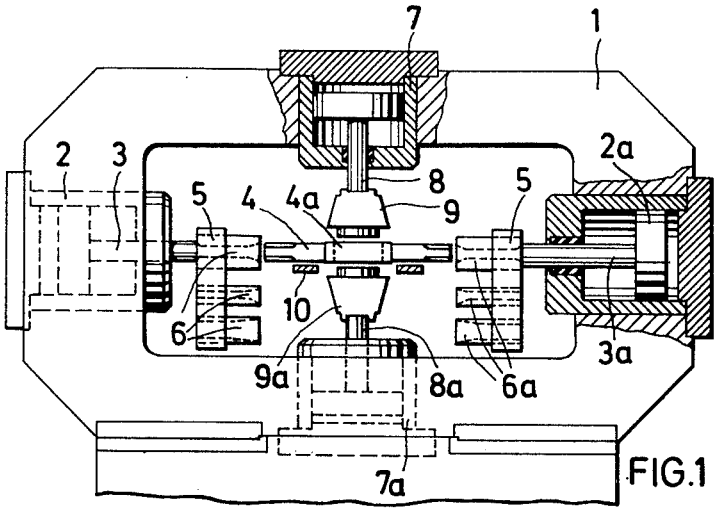
FIG. 1 is a side view partly sectioned of a press in accordance with the invention.

In FIG. 1 the press frame is indicated by the reference numeral 1. Two opposite and horizontally mounted press cylinders 2 and 2*a* are provided in the press frame. The piston rods 3 and 3*a* for the press cylinders are moveable in a longitudinal direction of a pipe-like work piece 4 and in a direction toward each other. Turret heads 5 and 5*a* are rotatably mounted at the front ends of the piston rods 3 and 3*a*. A plurality of working tools 6 and 6*a* are provided on the turret heads. The working tools 6 and 6*a* constitute drawing-in rings in the shown embodiment. Instead of such drawing-in rings, expansion mandrels or similar working tools may be mounted on turret heads 5 and 5*a*. Two clamping cylinders 7 and 7*a* are mounted in the press frame 1 which run vertically and in the same plane as the two press cylinders 2 and 2*a*. The clamping cylinders 7 and 7*a* are provided with piston rods 8 and 8*a* which run laterally with respect to the longitudinal axis of the work piece and toward each other. Clamping jaws 9 and 9*a* are mounted at the front end of the piston rods. The clamping jaws 9 and 9*a* are provided with round shoulders which engage the annular-like center portion 4*a* of the work piece 4 and support the same on the inside.

Beneath the work piece 4, a plate belt 10 is provided which is positioned vertically with respect to the plane of press frame 1, and which runs laterally through the opening of press frame 1. The work pieces 4 are successively mounted on this plate belt 10. After the work piece 4 lying on plate belt 10 between press cylinders 2 and 2*a* is moved, the clamping cylinders 7 and 7*a* are actuated, so that the clamping jaws 9 and 9*a* arrest the work piece 4 in the working position. Thereafter, by rotating the turret heads 5 and 5*a*, the required tools 6 and 6*a* are brought into operating position and the press cylinders 2 and 2*a* are actuated. Thereby, the end portions of the work piece 4 are deformed as desired. The axial forces which are exerted on work piece 4 by press cylinders 2 and 2*a* are balanced out with respect to each other, so that the clamping means does not have to absorb any forces. The clamping jaws 9 and 9*a* support the ring-like center portion 4*a*, in such a manner that the same cannot collapse. If further deforming steps are required on the end portions of the work piece 4, the press cylinders 2 and 2*a* are retracted and the turret heads 5 and 5*a* are rotated until they assume the desired working position. At that time, the working process is repeated again.

After the working process, the clamping jaws 9 and 9*a* are released from the clamping device and the finished work piece is removed from the plate belt 10 of the press.

Figure 2:
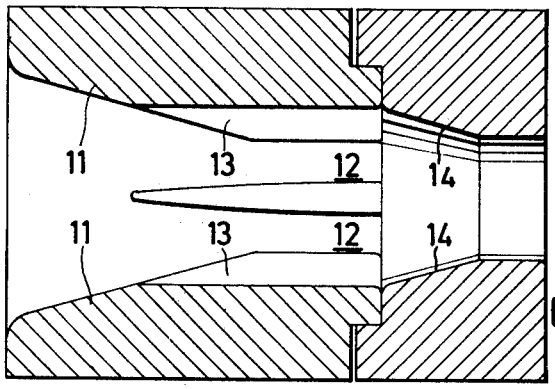
FIG. 2 is a longitudinal sectional view through a working tool on the press in accordance with the invention.

FIG. 2 shows a preferred embodiment of the invention which shows the drawing-in ring which acts as the actual working tool 6 and 6*a*. This drawing-in ring is provided with a small cone angle of about 15° at the range 11 of the inlet opening for the work piece. In the subsequent center area 12, a plurality of radially inwardly directed ribs 13 are provided and distributed over the internal circumference which press inwardly directed folds in the work piece 4. Subsequent to this portion, a conical tapered end portion is provided having a cone angle which is larger than 15°. In this area, the folds which were formed on the outer circumference on the work piece 4 in the center range are closed, so that a smooth cylindrical surface is obtained.

Figure 3:
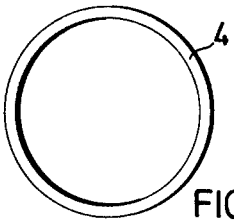
FIG. 3 is a sectional view through an undeformed work piece.
Figure 4:
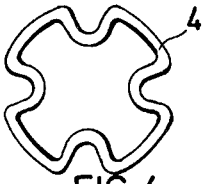
FIG. 4 is a sectional view through a partially deformed work piece.
Figure 5:
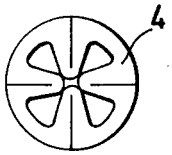
FIG. 5 is a sectional view through a finally deformed work piece.

FIGS. 3, 4 and 5 show how work piece 4 is progressively deformed in the areas 11, 12 and 14. In FIG. 3, the work piece 4 is still undeformed. In FIG. 4, folds are formed on the outer surface of the work piece by the ribs 13. In FIG. 5, the folds on the outer surface of the work piece 4 are closed, so that a continuous cylindrical surface is provided at the outer circumference of the work piece.

While only a single embodiment of the present invention has been shown and described, it will be obvious to those skilled in the art that many changes and modifications may be made thereunto without departing from the spirit and scope of the invention.

What is claimed is:

1. A hydraulic press for metal working of end portions of rod-like or pipe-like metallic work pieces, comprising:

a central clamping means for arresting the work piece including two oppositely disposed horizontal hydraulic cylinders having piston rods, clamping jaws mounted on said front facing ends of said piston rods of said hydraulic cylinders, the latter constituting clamping cylinders, said clamping jaws being adjusted to the form of a center section of said work piece solely for the support thereof without absorption of any pressure forces therefrom and including round shoulders for supporting a ring-like center section of said work piece whereby to avoid collapse of the ring-like center section thereof;

two oppositely disposed hydraulic press cylinders having piston rods which move toward the work piece;

individual working tools disposed on said piston rods of said press cylinders, said individual tools having a shape of a conical draw-in ring having a small conical angle at a range of an inlet opening for said work pieces, and in a center section having a plurality of radially inwardly extending ribs, and in an end section having a second conical angle larger than said small conical angle, said inlet opening having a diameter at least 1.3 times greater than the diameter of said outlet opening to provide a deformation ratio greater than 1.3, said ribs including radial extensions adjusted to and coordinated with the smallest diameter of said end section of said draw-in ring, whereby folds which are created on the outer circumference of the work piece in said end section of the draw-in ring by said ribs are completely closed on the outer circumference of the work piece, said press cylinders including said piston rods thereof being disposed on both sides of said clamping means;

means for moving said piston rods of said press cylinders toward each other in a longitudinal direction of said work piece; and means laterally moving said hydraulic cylinders in axial alignment with each other with respect to the longitudinal direction of said work piece whereby to avoid the absorption of any forces by said clamping means.

2. The hydraulic press according to claim 1 wherein the press cylinders and said hydraulic cylinders, constituting clamping cylinders, are positioned in a common vertical plane.

3. The hydraulic press in accordance with claim 1 wherein said press cylinders are positioned horizontally and said hydraulic cylinders are positioned vertically.

* * * * *